United States Patent [19]

Check et al.

[11] 4,195,448

[45] Apr. 1, 1980

[54] TWO-POINT CONTACT STEADY REST FOLLOWER

[75] Inventors: John M. Check, Chelsea; Gary F. Rupert, Ann Arbor, both of Mich.

[73] Assignee: Raycon Corporation, Ann Arbor, Mich.

[21] Appl. No.: 905,405

[22] Filed: May 15, 1978

[51] Int. Cl.[2] ..... B24B 49/02; B24B 41/06

[52] U.S. Cl. ..... 51/165.77; 51/238 S

[58] Field of Search ..... 51/238.1, 238 R, 236, 51/103 WH, 165.77

[56] References Cited

U.S. PATENT DOCUMENTS

| | | | |
|---|---|---|---|
| 1,961,091 | 5/1934 | Smith | 51/238 S |
| 2,160,378 | 5/1939 | Balsiger | 51/238 S |
| 3,425,168 | 2/1969 | Porath | 51/238 R |
| 3,427,755 | 2/1969 | Levesque | 51/238 R |
| 3,427,762 | 2/1969 | Mills | 51/238 R |
| 3,487,588 | 1/1970 | Temple | 51/165.77 |
| 3,591,988 | 7/1971 | Price | 51/238 R |
| 3,736,114 | 5/1973 | Okada | 51/238 S |
| 3,743,490 | 7/1973 | Asano | 51/238 S |
| 3,967,414 | 7/1976 | Tamesui | 51/238 S |

FOREIGN PATENT DOCUMENTS

| | | | |
|---|---|---|---|
| 301352 | 8/1954 | Sweden | 51/238.1 |
| 764493 | 12/1956 | United Kingdom | 51/238 S |

*Primary Examiner*—Harold D. Whitehead

*Attorney, Agent, or Firm*—Olsen and Stephenson

[57] ABSTRACT

A steady rest follower for a workpiece comprising a frame supporting a slide which is movable in directions toward and away from the workpiece. A pair of vertically spaced support wheels are mounted on the slide for engagement with the workpiece. A pair of springs yieldably urge the slide rearwardly away from the workpiece and into engagement with the peripheral surface of an eccentrically configured roller member that is mounted on the frame. During the machining of the workpiece, the eccentric roller member is rotated to move the slide against the pressure of the springs toward the workpiece so that the support roller members are maintained in continuous engagement with the workpiece as the size of the workpiece is reduced.

3 Claims, 2 Drawing Figures

TWO-POINT CONTACT STEADY REST FOLLOWER

BACKGROUND OF THE INVENTION

The present invention relates to a two-point contact steady rest follower for supporting the intermediate portions of a workpiece as it is operated on by a work performing tool such as a grinding wheel. Steady rest followers consist generally of two or three point contact arrangements wherein contact members or rollers are maintained in continuous engagement with the workpiece as it is reduced in size. The conventional steady rest followers, however, either require the use of sophisticated devices in order to maintain the proper backup support for a workpiece, or, if simply constructed, they fail to provide the proper support for the workpiece against a work performing tool.

It is the general object of the present invention, therefore, to provide an improved steady rest follower which is automatically adjustable to maintain a desired supporting contact with a workpiece as its size is reduced.

SUMMARY OF THE INVENTION

In accordance with the present invention, a steady rest follower is provided comprising a frame supporting a slide member for movement in directions toward and away from a workpiece. A pair of vertically spaced support wheel members are rotatably mounted on the slide at its front portion and are adapted to engage the upper and lower lateral sides of the workpiece. The upper and lower points of engagement on the workpiece by the support wheel members enables the steady rest follower to eliminate up and down vibration of the workpiece and also provides an equal and opposing force against the force generated when a grinding wheel is moved into the workpiece during machining. An eccentrically configured roller member is mounted on the frame rearwardly of the slide and has an axis of rotation that extends generally transversely and perpendicularly to the direction of movement of the slide. A pair of springs serve to urge the slide rearwardly into engagement with the roller or drive member. A stepping motor or a DC motor operates to rotate the eccentric roller member to move the slide member against the force of the springs toward the workpiece as material is being removed from the workpiece.

An electronic gauge on the frame monitors the size of the workpiece and generates a signal which is representative of the size of the workpiece. The signal is transmitted to a microprocessor which in turn controls the stepping motor to advance the slide as material is removed from the workpiece. Consequently, the support roller members are maintained in continuous engagement with the workpiece to provide the desired backup support for the workpiece. The microprocessor also controls the grinding operation. The feed and speed of the grinding wheel are controlled to accurately machine the workpiece.

Further objects, features and advantages of the present invention will become apparent from a consideration of the following description when taken in connection with the appended claims and the accompanying drawing in which:

FIG. 1 is an elevational view of the steady rest follower of the present invention taken substantially from line 1—1 in FIG. 2 and showing the steady rest follower incorporated in a grinding system; and FIG. 2 is a top view of the steady rest taken substantially from line 2—2 in FIG. 1.

DESCRIPTION OF THE PREFERRED EMBODIMENTS

Figure 1:
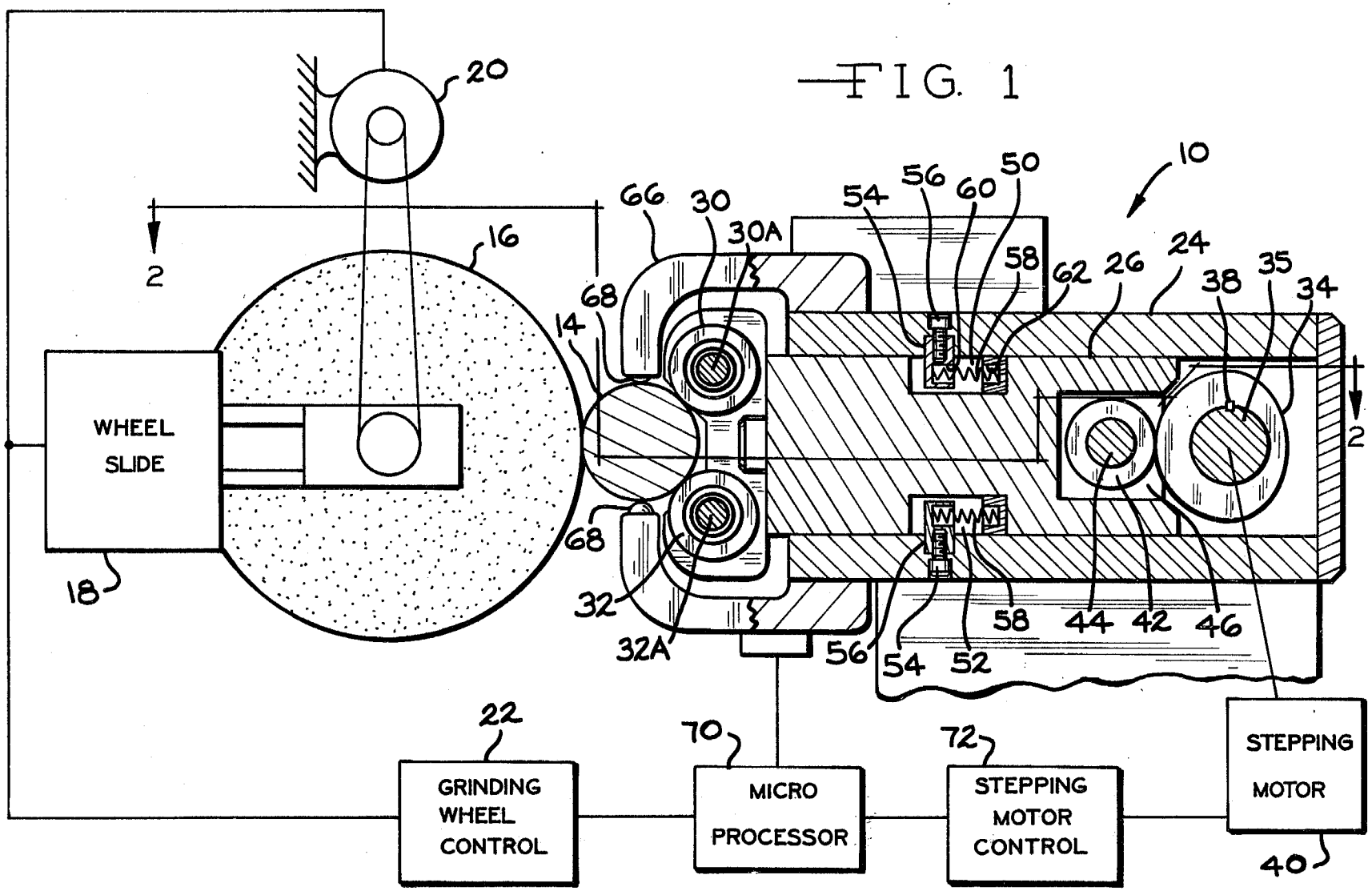
Figure 2:
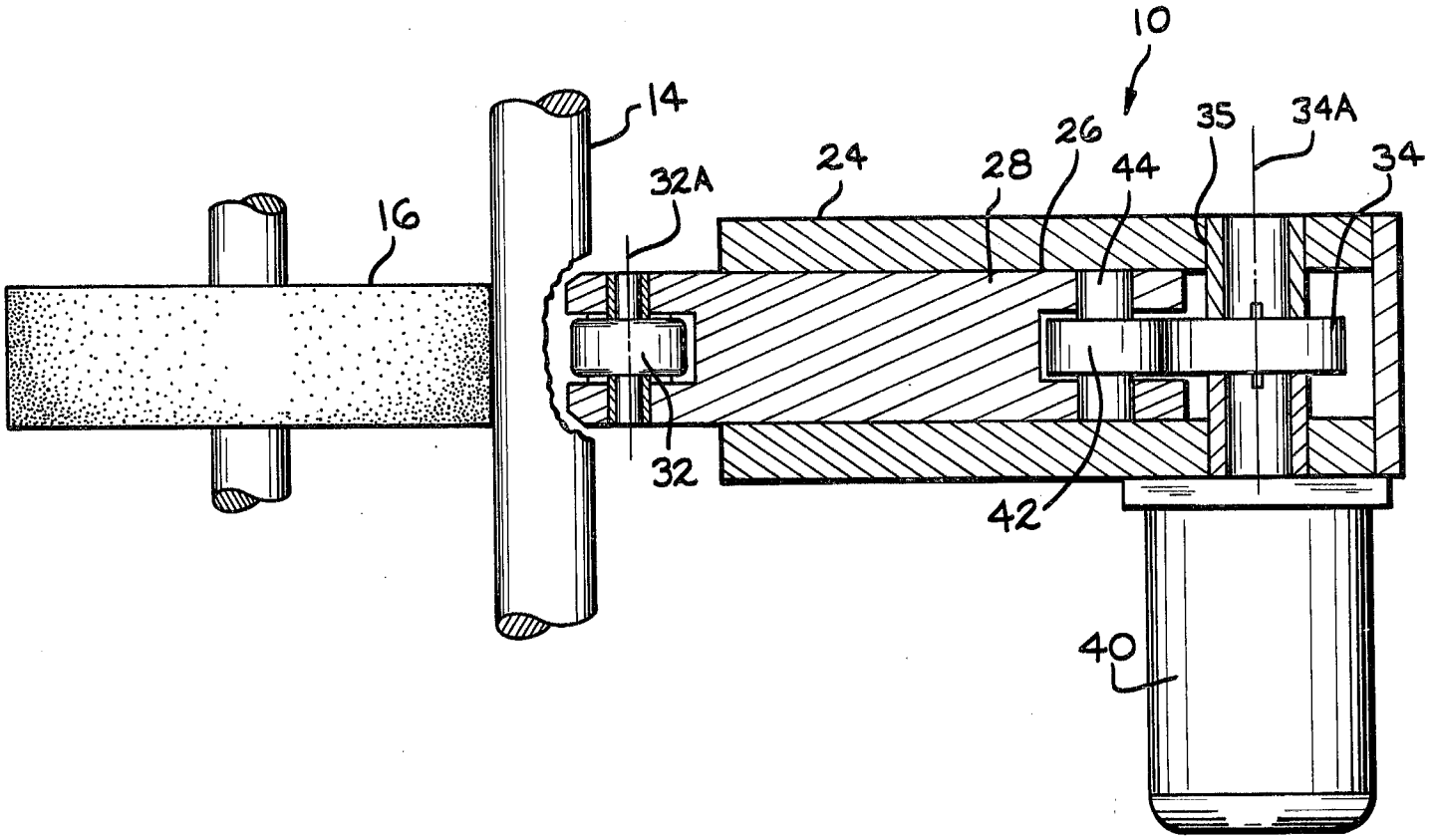

Referring to the drawing, the steady rest follower of the present invention, indicated generally at 10 in FIGS. 1 and 2 is adapted to be used in conjunction with a machining system 12 for performing an operation on a workpiece 14. The system 12 includes a work performing tool such as a grinding wheel 16 that is mounted on a wheel slide 18 for movement transversely of the workpiece 14. The grinding wheel 16 which is movable toward and away from the workpiece 16 in a feeding operation, is driven by a grinding motor 20 to reduce the size of the workpiece 14. A grinding wheel control 22 is operable to control the position of the grinding wheel 16, its feed, and the speed at which it is driven.

The steady rest follower 10 is located directly opposite to the grinding wheel 16 and through suitable means (not shown) is moved transversely of the workpiece 14 as the grinding wheel 16 is moved transversely of the workpiece 14. The steady rest 10 serves to provide an opposing force against the workpiece 14 to offset the forces that are generated by the grinding wheel 16 as it is moved into the workpiece 14 so that a workpiece having the desired size and roundness can be machined. The steady rest follower 10 includes a frame 24 having a generally rectangular cavity 26. A rectangular slide body 28 slidably fits into the cavity 26 and is movable forwardly and rearwardly relative to the frame 24 in opposite directions toward and away from the workpiece 14.

A pair of support wheel members 30 and 32 are mounted at relatively fixed positions on the slide 28 at its front and in vertical spaced apart relation with each other, as seen in FIG. 1. The wheel members 30 and 32 are freely rotatable about their axes of rotation 30A and 32A which extend transversely of the slide body 28 and its direction of movement. The wheel members 30 and 32 form contact means for engaging the workpiece 14 during machining. The upper wheel member 30 engages the upper lateral side of the workpiece 14 and the lower wheel member 32 engages the lower lateral side of the workpiece 14. In addition to providing a horizontal resistive force against the pushing force of the grinding wheel 16 against the workpiece 14, by virtue of their positions on the upper and lower lateral side of the workpiece 14, the wheel members 30 and 32 effectively eliminate up and down vibrations induced by the grinding wheel 16.

An eccentrically configured roller member 34 is mounted on an axle 35 which is rotatably mounted on the frame 24 at a position rearwardly of the slide 28. The roller member 34 has an axis of rotation 34A that extends generally transversely or perpendicularly to the direction of movement of the slide 28. The roller member 34 is fixed on the axle 35 by a key 38 and the axle 35 is suitably connected to the output of a stepping motor 40 which operates to rotate the roller 34.

A cylindrical member 42 is mounted on a pin 44 that is in turn mounted on the slide 28 at its rear portion. An opening 46 is formed in the slide 28 for receiving the cylindrical member 42. The pin 44 is thus rotatably mounted on the opposite side walls with the member 42 being positioned inwardly of said slide 28 to provide a compact unit. The member 42 engages the roller 34 along a line where the surfaces of the roller 34 and the cylindrical member 42 contact each other.

An upper pocket or cavity 50 and a lower pocket or cavity 52 are formed in the slide 28. Anchor pins 54 are removably mounted on the frame 24 by screw members 56 and extend into the pockets 50 and 52. A pair of compression springs 58 urge the slide 28 rearwardly for maintaining continuous engagement between the surface of the member 42 and the surface of the roller 34. Each spring 58 is positioned in a hole 60 of an associated anchor pin 54 and in a sleeve 62 positioned in the pocket 50 in engagement with the slide 28 at a position rearwardly of the anchor 54.

A gauge 66 having feelers 68 is mounted on the frame 24. The feelers 68 are operable to maintain continuous engagement with the workpiece 14 to monitor its size and roundness. The gauge 66 produces an electrical signal that is representative of the actual size and roundness of the workpiece 14. This signal is transmitted to a microprocessor 70 programmed to carry out a variety of functions. The microprocessor 70 activates the stepping motor control 72 to operate the stepping motor 40 to rotate the eccentric roller member 34 to the desired position maintaining continuous contact between the rollers 30 and 32 as the size of the workpiece is reduced. The microprocessor 70 also controls through the grinding wheel control 22, the feed and speed of the grinding wheel 16 along with its transverse movement to machine the workpiece 16 to the desired size and roundness.

In operation, the workpiece 14 is mounted on its normal workpiece supports (not shown) and the follower 10 is moved into a position in which the support wheel members 30 and 32 are engaged with the workpiece 14. Grinding is initiated and as the size of the workpiece 14 is reduced, the gauge 66 generates a signal that is transmitted to the microprocessor 70. The microprocessor 70 transmits a signal to the stepping motor control 72 to activate the stepping motor 40 to rotate the eccentric roller member 34. Since the radial distance between the axis 34A and the peripheral surface of the roller 34 varies, the position of the slide 28 relative to the frame 24 can be varied by rotation of the roller 34 since the springs 58 yieldably press the slide 28 against the roller 34. As the size of the workpiece 14 is reduced, the roller member 34 is driven by the stepping motor 40 to move the slide 28 forwardly so that continuous engagement between the rollers 30 and 32 and the workpiece 14 is maintained. When the final workpiece size has been attained, the microprocessor 70 transmits a signal to the grinding wheel control 20 to terminate grinding and retract the grinding wheel 16.

From the above description, it can be seen that an improved steady rest follower is disclosed utilizing an eccentric roller member 34 that is rotated to move the roller members 30 and 32 forwardly to maintain a constant backup support against the workpiece 14. The microprocessor 70, operatively associated with the gauge 66 and the stepping motor 40 ensures that a workpiece having the desired size and roundness is machined.

What is claimed:

1. A steady rest follower for supporting a workpiece as material is removed therefrom by a work performing tool, said steady rest follower comprising a frame, a slide movably mounted on said frame for movement toward and away from said workpiece, bias means connected to said frame and said slide urging said slide away from said workpiece, a pair of workpiece engaging members mounted on said slide at relatively fixed positions, gauge means operable to monitor the size of said workpiece and generate a signal representative of the size of said workpiece, drive means for moving said slide transversely of said workpiece to a position in which said workpiece engaging members engage the upper and lower lateral portions of said workpiece on the side of said workpiece opposite the side engaged by said tool, said drive means comprising a drive member rotatably mounted on said frame, a curved contact member mounted on said slide in direct contact with said drive member, said drive member having an eccentric portion with an axis of rotation extending transversely with respect to the direction of movement of said slide, motor means operable to rotate said drive member about its axis to move said slide toward and away from said workpiece in cooperation with said bias means, and control means operatively associated with said gauge means and said motor means so that in response to a signal indicating a decreasing workpiece size from said gauge means said control means provides for the operation of said motor means to rotate said drive member to advance said slide toward the workpiece to maintain a controlled support force against the workpiece by said workpiece engaging members as the size of said workpiece is reduced.

2. The steady rest follower according to claim 1 further including an anchor pin removably connected to said frame, said anchor pin having a cavity for receiving one end of said spring member, the other end of said spring member being engaged with said slide so as to urge said slide away from the workpiece.

3. The steady rest follower according to claim 1 wherein said curved contact member has a circular surface and an axis of rotation that is parallel with the axis of rotation of said drive member, said contact member being rotatable about its axis in response to rotation of said drive member.

* * * * *